United States Patent [19]

Christensen

[11] Patent Number: 5,072,208

[45] Date of Patent: Dec. 10, 1991

[54] ELECTROMECHANICAL CHAOTIC CHIMING MECHANISM

[76] Inventor: John J. Christensen, 349 Scenic Pl., Manteca, Calif. 95336

[21] Appl. No.: 547,820

[22] Filed: Jul. 2, 1990

[51] Int. Cl.[5] ..... G08B 3/00; G10K 1/00

[52] U.S. Cl. ..... 340/392; 340/384 R; 340/395; 116/141

[58] Field of Search ..... 340/392–395, 340/384 R; 116/141

[56] References Cited

U.S. PATENT DOCUMENTS

| | | | |
|---|---|---|---|
| 2,206,837 | 7/1940 | Edwards | 340/392 |
| 2,270,085 | 1/1942 | Schwinzer | 340/392 |
| 2,506,009 | 5/1950 | Bergeron | 340/392 |

*Primary Examiner*—Donnie L. Crosland

[57] ABSTRACT

An electromechanical chaotic chiming mechanism, analogous to the classical wind or water powered chime, includes a body or framework suspending a series of chimes with a pendulum suspended centrally among the chimes. A drive mechanism for the pendulum includes a permanent magnet on the pendulum and a drive electromagnet in a base positioned just below a centered rest position of the pendulum. With the electromagnet switched on and off, in a regular linear pattern, the electromagnetic drive causes a chime hammer on the pendulum to behave in a chaotic manner, sounding the chimes in a fashion virtually indistinguishable from natural meteorological forces acting on conventional windchimes. Variations can be made to the pattern or period of the drive electromagnet to vary the pattern of sound produced by the chimes.

7 Claims, 4 Drawing Sheets

ELECTROMECHANICAL CHAOTIC CHIMING MECHANISM

BACKGROUND

1. Field of the Invention

This invention relates to windchimes, specifically to a novel electromechanical analog of the windchime, which may be operated without wind.

2. Discussion of Prior Art

Windchimes have been an artistic creation of mankind for millennia. Artists and craftsmen the world over have created chiming bells or sounding mechanisms, operated by wind or water in countless forms, shapes and sounds.

Recently, windchime sounds have been duplicated by recording or by electronically synthesizing the appropriate wave forms. Examples of these techniques exist today in forms such as greeting cards, electronic novelty chimes and many musical synthesizers.

Numerous disadvantages of these methods include the following examples:

a. The purely mechanical varieties of chimes depend on winds or water as motive power for their operation and typically require installation of out-of-doors. This usually means they are inaudible indoors unless doors or windows are open. Thus, enjoyment of the beautiful, random sounds they produce can be restricted to periods of good weather.

b. During periods of windy or blustery weather, purely mechanical chimes can create excessive noise, even become annoying.

c. The multitude of electrical or electronic chimes solve the weather related problems but lack the visual appeal of the classical, purely mechanical devices. Additionally, to achieve a truly random melody similar to actual windchimes, the playback process requires elaborate randomizing techniques be used to avoid repetition.

d. Electronically synthesized versions of the random chime may offer greater ease in recreating random sequencing of the conventional windchime. However, the recorded or synthesized reproduction of the chiming usually lacks the natural tonality, variance of pitch and timbre of conventional mechanical chimes. Also, since the purely electronic analog is usually nothing more than a box and speaker, these devices are visually boring.

e. Even if the latest recording or synthesizing techniques are employed to attempt to overcome these above limitations, this solution is usually prohibitively expensive.

No windchime apparatus in the prior art had the advantages of visual appeal, randomness, true windchime tonality, pitch and timbre, and indoor/outdoor application as exhibited by the present invention described below. The only pertinent art known to the applicant, in addition to that described above, is the chaotic or unstable pendulum. This invention differs significantly from the unstable pendulum device in that the pendulum of the present chime is essentially a stable linear one, similar to that described by Isaac Newton. In this invention the pendulum and chime system only behave chaotically when operated together as a system. The pendulum alone can be operated in a regular or linear mode, which is impossible for the novelty chaotic or unstable pendulum. Also, the chaotic pendulum, which is visually interesting, is incapable of creating sound.

SUMMARY OF THE INVENTION

The electromechanical chaotic chiming apparatus of this invention utilizes a normally stable pendulum drive mechanism in combination with chimes which interrupt the pendulum's motion and turn it chaotic. A pleasing random windchime sound results.

Besides the objects and advantages of the age-old windchime mechanism described above, several objects and advantages of the present invention are:

a. The visually stimulating and acoustically superior mechanical chimes have been combined with a novel electromagnetic drive mechanism that utilizes chaotic principles to achieve random soundings that simulate the natural action of wind or water.

b. The device can be operated and enjoyed indoors independent of the weather, yet adjusted to simulate windchime action of various weather conditions, from occasional gentle gusts to a steady breeze.

c. Since the chime is electromechanical, it can be used in many timing applications where windchimes are not normally found, such as sounding the quarter-hour. This is of value when the device is incorporated into a commercial sculpture and/or sequenced with artistic lighting display.

d. The electromechanical chime lends itself easily to styling variations and alterations which can enhance marketability. The principles of operation are independent of size, shape, chime design or materials. Many variations of the electromechanical chime system can be developed to enhance the chime's versatility as a commercial art form or novelty item.

DESCRIPTION OF THE DRAWINGS

FIG. 5*b* illustrates chaotic behavior due to phase interruption caused by the collisions. Both FIGS. 5*a* and 5*b* should be considered as three-dimensional pendulum motion representations, even though the motion is illustrated on the graph in only two dimensions.

DESCRIPTION OF PREFERRED EMBODIMENTS

Figure 1:
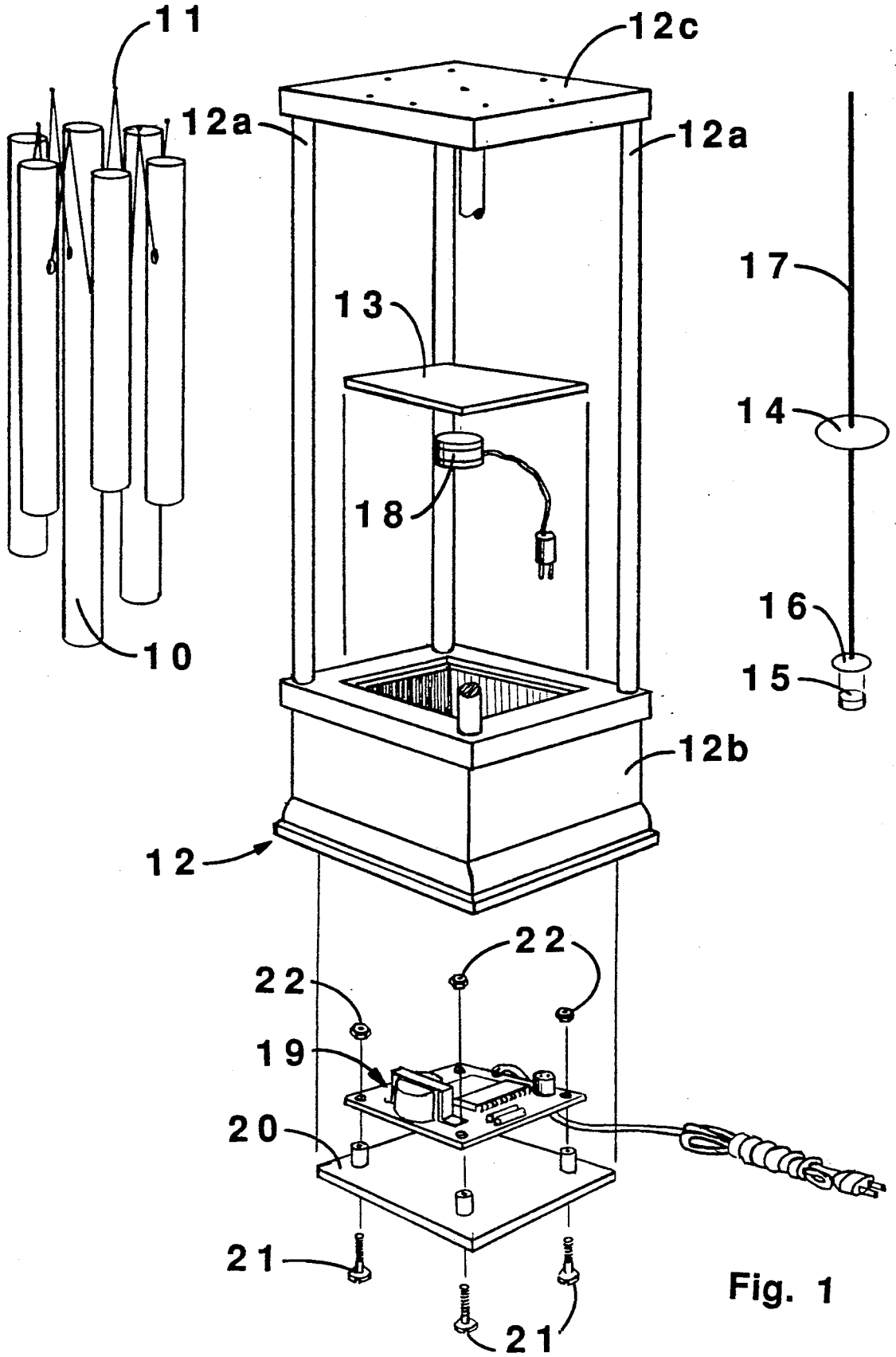
FIG. 1 is an exploded assembly view showing one embodiment of the invention showing the basic components and their arrangement.
Figures 4A, 4B, 4C:
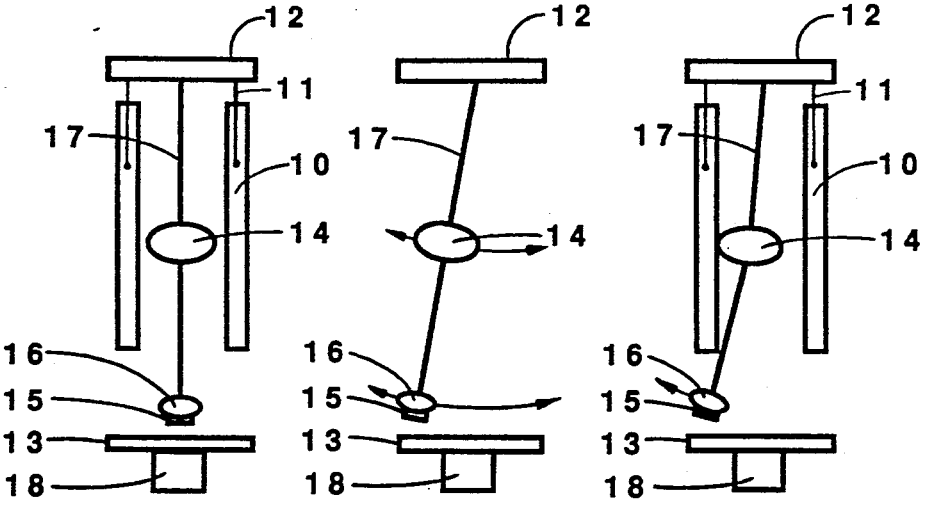
FIGS. 4*a*, 4*b* and 4*c* illustrate conditions for chaotic behavior of the system, with FIG. 4*a* showing the system at rest, FIG. 4*b* showing linear or regular motion of the pendulum with the chimes removed, and FIG. 4*c* illustrating the combined effect of the electromagnet and the interfering chimes to produce chaotic motion.
Figure 5A:
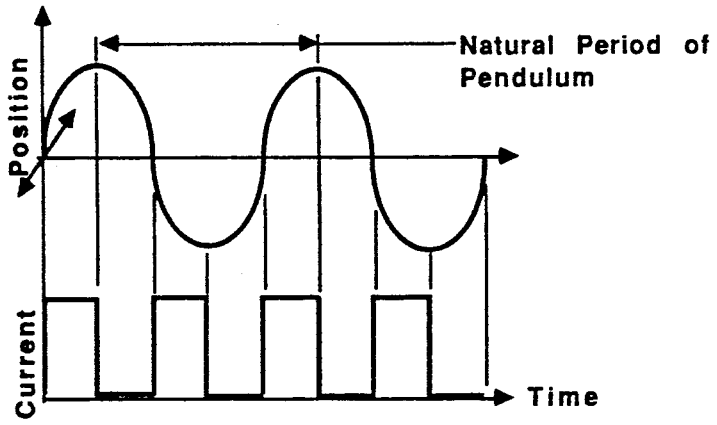
FIG. 5*a* illustrates the timing relationships between the drive magnet current and the free pendulum swing, corresponding to what is shown in FIG. 4*b*.
Figure 5B:
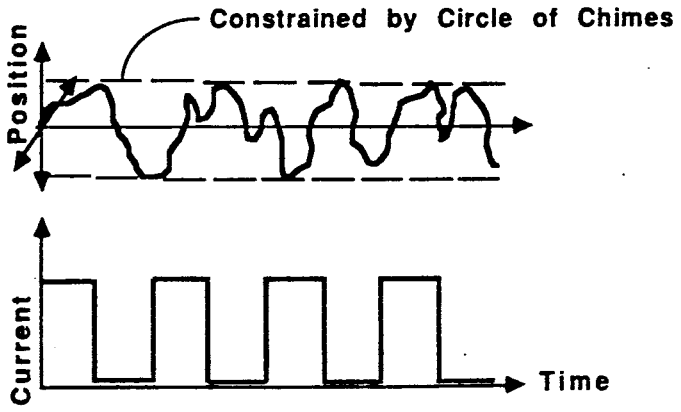
FIG. 5*b* illustrates what will occur with chime collisions interrupting the free pendulum swing, corresponding to FIG. 4*c*.
Figure 6:
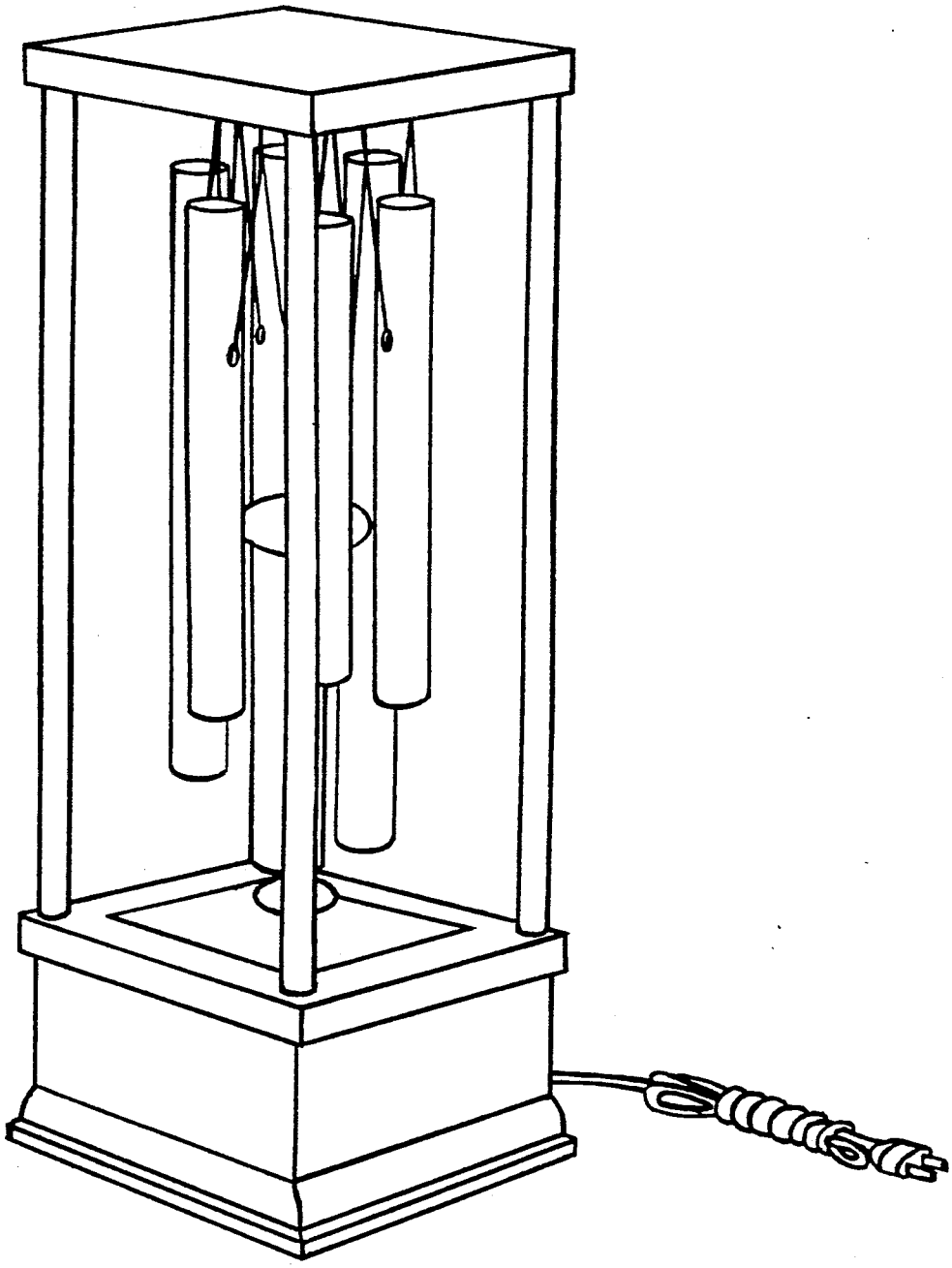
FIG. 6 is a perspective view showing the assembled chaotic chiming mechanism. (A second version of FIG. 6 without part numbers or lead lines is included for convenience.)

A typical embodiment of electromechanical chaotic chiming mechanism is illustrated in FIG. 1 (exploded assembly view), and in FIG. 6. The schematic views of FIGS. 2 through 5*b* illustrate various details of operation and configuration.

The parts of the chime mechanism may be divided into four main groups. They are:

1. The Body (housing or framework).
2. The Chimes (sounding mechanisms).
3. The Drive Mechanism and Chime Hammer.
4. The Electronics Package.

THE BODY

The body 12 and chime support cords 11 support and position a set of chimes 10 in proximity to a chime hammer or striker 14, for being struck. This particular body assembly (many are possible) embodies four uprights 12*a*, a base 12*b*, and a top 12*c* which acts as a chime mount. The four uprights support and position the top chime mount 12*c* over the base 12*b*. The base contains a drive magnet 18 and may contain timing electronics as well. The styling of this group, including choice of materials of fabrication, can be manipulated to achieve various esthetic effects while maintaining common functionality. For the purpose of this patent, the entire assembly will be referred to generally a the body 12.

As shown in FIG. 1, the base 12*b* may have a drive magnet mount plate 13 under which the drive magnet 18 is mounted. A base or bottom plate 20 closes the body 12 from below, secured by fasteners such as bolts 21 and nuts 22.

THE CHIMES

The chime group 10 comprises sounding mechanisms which may include tuned bells, tubular chimes, rods, seashells, gongs or other items selected for their musical or tonal qualities when struck. The only limitation to the type of sounding mechanism used is that the striker or hammer used to sound the chime be of appropriate size, mass and shape to effectively operate the mechanism.

In the example described herein, tuned resonant metal tubes are selected as chimes. These chimes 10 are suspended from the top chime mount by chime support cords 11. These appropriately sized and styled cables, cords, ropes or chains position the chimes such that the striking hammer has equal access to each chime. Unlike classical windchimes, the chime hammer and chime must be in close proximity.

THE DRIVE MECHANICS AND CHIME HAMMER

Figure 2:
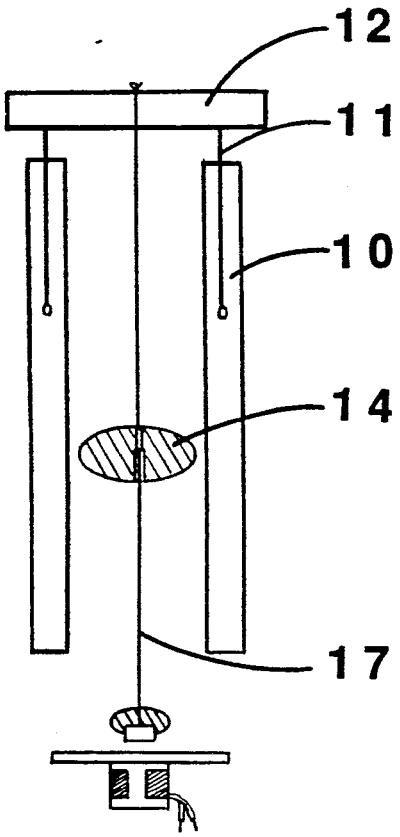
FIG. 2 is a schematic of a typical design embodying the invention. It shows the spatial relationships of chime tubes, chime hammer and pendulum.
Figure 2A:
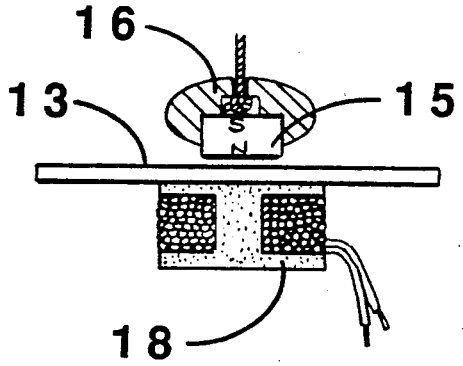
FIG. 2*a* is an enlarged schematic of a portion of FIG. 2, giving a detail of an electromagnetic drive mechanism.

The drive mechanism and chime hammer group, as illustrated in FIGS. 1 and 2, include a pendulum support cord 17, the chime hammer 14, the pendulum magnet 15 (a permanent magnet) and a pendulum magnet cover 16. Referring to FIGS. 2 and 2*a*, the pendulum assembly is positioned directly over the drive electromagnet 18. Again as shown in FIGS. 2 and 2*a*, the pendulum magnet 15, suspended at the bottom of the pendulum support cord 17, should be in close proximity to the drive electromagnet pole piece 18, such that there is a strong attractive force between the magnet 15 and the iron pole piece of the drive electromagnet 18. This attraction will exist in the absence of the drive magnet electrical current. For example, in a chime apparatus with a pendulum support cord length of 20.5 inches, a one-half inch diameter permanent magnet with an average flux strength of 4,500 to 6,000 gauss and a one-half inch diameter electromagnet possessing an energized strength of 7,000 gauss, the spacing between the magnets should be in the range of about one-quarter inch to one-half inch.

Referring to FIG. 1, the drive electromagnet 18 is electrically connected to the magnet drive electronics 19. The connection is made such that when drive current is switched on, the drive magnet electromagnetic field is of similar polarity to the adjacent fixed magnetic field of the driven magnet 15, and the pendulum is repelled.

Figure 3A:
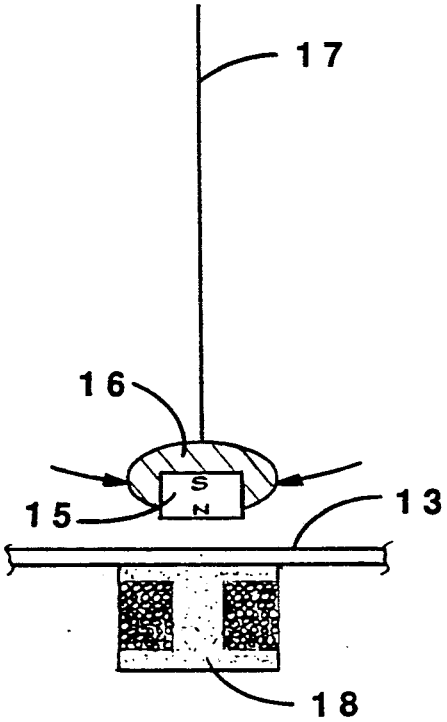
FIG. 3*a* and FIG. 3*b* are schematics of the pendulum drive, showing attraction of the pendulum to a centered position when the driving electromagnet is "off", and showing repulsion of the pendulum away from center when the electromagnet is "on".
Figure 3B:
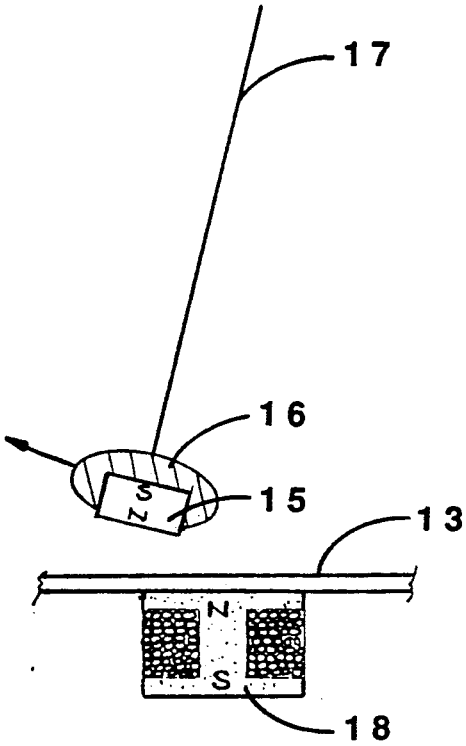

FIG. 3*a* illustrates a centering force caused by attraction between the pendulum magnet 15 and the drive electromagnet pole piece 18. This case exists when the drive electromagnet current is off. FIG. 3*b* illustrates the case when drive electromagnet current of the proper polarity is allowed to flow. The resulting magnetic field of the drive electromagnet 18, being of like polarity to that in the pendulum magnet 15, repels the permanent magnet in some arbitrary direction.

Thus, the electromagnet drive current may then be switched on and off, resulting in an alternating attraction (off), then repulsion (on) force between the two magnets. This alternating attraction and repulsion effect forms the basis of the pendulum drive system.

THE ELECTRONIC PACKAGE

Referring again to FIG. 1, the electronics package 19, located within the body 12 and attached to the base plate 20, provides the current pulses for the drive electromagnet 18. The electronics need only supply a simple train of regularly spaced pulses of electromagnet drive current which are at a frequency of approximately twice the natural frequency of the pendulum. The simple on-off pulse train is all that is required for proper operation of the electromechanical chaotic chime.

As a further enhancement of the basic design, the electronics package may also control lighting or other features of the display.

One feature of the invention is that the period of the applied drive may be fixed or variable. The duty-cycle of the pulses may be varied or fixed, and the drive magnet current pulses may be linear (periodic, regular) or non-linear (aperiodic or interrupted). The chaotic action of the pendulum and chime hammer or striker is independent of this parameter. Adjustment of the aforementioned parameters can, however, influence the overall operation of the system. For example, the duty-cycle of the pulse train can be periodically interrupted or varied to simulate the natural variation of wind intensity.

The particular selection of individual design parameters including size, shape, type of chime, possible timed or synchronized lighting or displays, will influence the final design of the magnet drive circuit, to meet the design objectives of the particular application. No particular circuit is described herein, although FIGS. 5*a* and 5*b* show in graphic form a simple on/off cycle for the electromagnet drive. Any appropriate form of timing device can be used for switching, and the circuitry to be employed is well within the capability of those skilled in the art.

OPERATION

The operation of an embodiment of the electromechanical chaotic chiming mechanism of the invention is described below. This operation applies to all embodiments of this invention regardless of physical size or shape. Prototypes have been built and operated which varied in size from desk top (25 inches tall) to a custom version, designed and built as a focal point of an office mall foyer (16.5 feet tall).

The body for this particular design embodies four uprights 12*a* supporting the top chime mount 12*c*, and tubular chimes 10 as previously described. The four uprights support and position the chime assembly and pendulum assembly over the base 12*b* containing the drive magnet and timing electronics.

The chime group in one preferred embodiment comprises cylindrical tuned resonant metal tubes selected for their musical or tonal qualities, when struck. The chimes are positioned such that the striking hammer has equal access to each chime, i.e. it is in approximately equal proximity to each chime when centered at rest.

Referring to FIG. 1, the chime drive mechanism includes the pendulum support cord 17, the pendulum magnet 15 and the chime hammer 14. This pendulum assembly, supported from the top chime mount, is positioned directly over the drive electromagnet 18, and in close enough proximity to the drive electromagnet pole piece such that there is a strong attractive force between the driven magnet 15 and the iron pole piece of the drive magnet 18 when the electromagnet is not energized. The pendulum support 17 may be of either rigid or flexible construction although the latter is preferred. The greater the flexibility of the pendulum support the greater the complexity of the resulting chaotic behavior.

The electronics assembly is switched on. In the simplest example, the drive oscillator switches the drive magnet current on and off as indicated in FIGS. 5*a* and 5*b*. This results in alternating attraction, then repulsion force between the driven and drive magnets. Since the drive magnet position is fixed, and the pendulum and driven magnet are free to move, motion occurs between the two bodies. Maximum relative motion between the two bodies will occur when the drive current pulses occur at a rate that approximately matches the natural frequency of the pendulum assembly, as shown in FIG. 5*a*.

The initial direction of the resultant motion is determined by whatever slight variances may exist in the initial positions of the two magnets. Referring to FIG. 4*b*, if the frequency of the applied drive magnet current cycle is adjusted to approximately twice the natural period of the pendulum, and the pendulum's travel is unhindered (that is, if there were no chimes to collide or otherwise interfere with the motion of the pendulum), the pendulum will settle quickly into classical regular motion, not unlike that of a clock. It is this ability of the pendulum to operate in a linear mode that separates this drive pendulum from the true chaotic pendulum, which, due to its design, cannot ever be made to operate in a linear fashion for extended periods. In the device of this invention, the chaotic action of the chime hammer is not due to the pendulum itself.

CHAOTIC ACTION OF THE CHIME HAMMER

Referring to FIGS. 4*a* and 4*c*, the drive pendulum and chime hammer, described above, are positioned intimately to chimes of an appropriate type and style, such as the tubular metal pipes used in this example. As shown in FIG. 4*c*, collisions will occur between the chime and the chime hammer, due to the motion imparted on the pendulum by the drive magnet and the closeness of proximity of the chime hammer and chimes. These collisions do two things:

First—they are the mechanism that sounds the chime.

Second—The collisions disturb and prohibit any linear behavior of the pendulum by imparting a phase error or phase interruption between the period of the applied drive magnet current and the period of the pendulum's swing. This phase error or interruption is further amplified by the rocking and swaying motion of the individual chimes, responding to the striking of the chime hammer. Due to their swing, the chimes no longer present equal access to the action of the chime hammer. The rocking and swaying of the chimes is not fundamental to achieving proper chaotic operation of the system but are simply a natural result of the collisions which further enhance the chaotic nature of the system.

The entire system, comprised of the chimes, chime hammer, drive and driven magnets almost instantaneously becomes chaotic. This constrained randomness effectively duplicates the action of wind or water to activate a chime mechanism. This basic action may be enhanced by any or all of the following adjustments to the drive magnet electronics:

1. Drive magnet current duty cycle can be varied. Adjusting this parameter imparts a modulation of the chaotic behavior which effectively duplicates the natural variations in the intensity of the wind.
2. Drive magnet frequency can be varied with time. As the drive magnet frequency is mismatched from the natural period of the pendulum the chaotic excursions of the chime hammer subside to less and less energetic behavior. This effectively duplicates a varying wind speed.
3. Drive magnet frequency can be switched or interrupted. Varying this parameter simulates natural interruptions of the wind. This feature may also employed to synchronize the chime to real world timing events such as announcing the hour.

However, for even the simplest operating configuration as described above, the resulting sounds are virtually indistinguishable from a classical windchime blowing in a gentle, steady breeze.

Thus, the electromagnetic chaotic chime device presents a novel appearance which embodies the visual and esthetic qualities of conventional wind or water powered chimes, while simultaneously providing faithful reproduction of classical windchimes sound, independent of any meteorological requirements. The adaptation of an electromagnetic drive creates many additional and novel application possibilities. Furthermore, the electromagnetic chime device embodies new features not normally found on weather activated devices.

These features include the following:

Programmability—the ability to be sequenced, timed or otherwise used as an annunciator, timer, warning or other indicator.

Adjustability—the ability to set the general mood of the operation independent of weather or location.

Although the description above contains many specific features, they should not be construed as limiting the scope of the invention but as merely providing illustrations of some of the presently preferred embodiments of this invention. The scope of the invention should be determined by the appended claims and their legal equivalents, rather than the examples given.

I claim:

1. An electromechanical chaotic chiming mechanism for producing a random, chaotic pattern of chime sounds similar to sounds produced by windchimes, comprising, a plurality of chimes each capable of producing a different sound when struck, mechanical striker means adjacent to the chimes for moving in a random manner within a space within which it can reach and strike the chimes, and electromagnetic drive means for producing a magnetic field when energized and for inducing movement of the mechanical striker means, which movement is random or chaotic when interrupted by collisions with the chimes, whereby the chimes are randomly struck by the mechanical striker means to produce a chiming sound similar to that of windchimes.

2. Apparatus according to claim 1, wherein the mechanical striker means has a natural period for a cycle of movement, and wherein the electromagnetic drive means is energized on and off in a pattern which approximately matches the natural period of the mechanical striker means, so that the mechanical striker means would move in a linear manner but for the collisions with the chimes, which cause the movement of the mechanical striker means to become chaotic or random.

3. Apparatus according to claim 2, wherein the mechanical striker means includes a permanent magnet, and wherein the magnetic field produced by the electromagnet drive means is of like polarity to a pole of the permanent magnet adjacent to the electromagnet drive means, whereby when energized the electromagnetic drive means repels the mechanical striker means tending to push it away and when not energized, the permanent magnet of the mechanical striker means is attracted toward an iron core of the electromagnet drive means.

4. Apparatus according to claim 1, wherein the mechanical striker means comprises a pendulum suspended from a mounting above the electromagnet drive means, the pendulum including a striker or hammer positioned to strike the chimes during movement of the pendulum, and the pendulum further including a permanent magnet at its lower end, with the electromagnetic drive means when energized producing a magnetic field of like polarity to that of an adjacent end of the permanent magnet.

5. Apparatus according to claim 4, wherein the pendulum has a natural period for a cycle of movement, and wherein the electromagnetic drive means is pulsed on and off in timing with the natural period of the pendulum.

6. Apparatus according to claim 4, wherein the pendulum comprises a rigid means or flexible cord with the permanent magnet at its lower end and with the striker or hammer mounted on the cord above the permanent magnet.

7. Apparatus according to claim 1, wherein the chimes each comprise a tubular cylindrical member.

* * * * *